US005533626A

United States Patent [19]

Nagaraj et al.

[11] Patent Number: 5,533,626

[45] Date of Patent: Jul. 9, 1996

[54] METHOD OF DEPRESSING NON-SULFIDE SILICATE GANGUE MINERALS

[75] Inventors: D. R. Nagaraj, Stamford; Samuel S. Wang, Cheshire; James S. Lee, Sandy Hook; Lino G. Magliocco, Shelton, all of Conn.

[73] Assignee: Cytec Technology Corp., Wilmington, Del.

[21] Appl. No.: 475,160

[22] Filed: Jun. 7, 1995

[51] Int. Cl.[6] ..... B03D 1/016; B03D 1/02

[52] U.S. Cl. ..... 209/167; 252/61

[58] Field of Search ..... 209/167, 166; 252/61

[56] References Cited

U.S. PATENT DOCUMENTS

| | | |
|---|---|---|
| 2,740,522 | 4/1956 | Aimone . |
| 3,929,629 | 12/1975 | Griffith . |
| 4,339,331 | 7/1982 | Lim . |
| 4,360,425 | 11/1982 | Lim . |
| 4,719,009 | 1/1988 | Furey . |
| 4,720,339 | 1/1988 | Nagaraj . |
| 4,744,893 | 5/1988 | Rothenberg . |
| 4,853,114 | 8/1989 | Lewis . |
| 4,866,150 | 9/1989 | Lipp . |
| 5,030,340 | 7/1991 | Panzer . |
| 5,057,209 | 10/1991 | Klimpel . |

*Primary Examiner*—Thomas M. Lithgow
*Attorney, Agent, or Firm*—F. M. Van Riet

[57] ABSTRACT

A method for the depression of non-sulfide, silicate gangue minerals is provided wherein the depressant is a polymeric mixture of a polysaccharide and a material comprising recurring units of the formula:

$$+X\frac{}{x} \quad +Y\frac{}{y} \quad +Z\frac{}{z}$$

wherein X is the polymerization residue of an acrylamide or mixture of acrylamides, Y is an hydroxy group containing polymer unit, Z is an anionic group containing polymer unit, x represents a residual mole fraction of at least about 35%, y represents a residual mole fraction of from about 1 to 50% and z represents a residual mole fraction of from about 0 to about 50%.

20 Claims, No Drawings

METHOD OF DEPRESSING NON-SULFIDE SILICATE GANGUE MINERALS

BACKGROUND OF INVENTION

The present invention relates to froth flotation processes for recovery of value sulfide minerals from base metal sulfide ores. More particularly, it relates to a method for the depression of non-sulfide silicate gangue minerals in the beneficiation of value sulfide minerals by froth flotation procedures.

Certain theory and practice states,that the success of a sulfide flotation process depends to a great degree on reagents called collectors that impart selective hydrophobicity to the mineral value which has to be separated from other minerals.

Certain other important reagents, such as the modifiers, are also responsible for the successful flotation separation of the value sulfide and other minerals. Modifiers include, but are not necessarily limited to, all reagents whose principal function is neither collecting nor frothing, but usually one of modifying the surface of the mineral so that it does not float.

In addition to attempts at making sulfide collectors more selective for value sulfide minerals, other approaches to the problem of improving the flotation separation of value sulfide minerals have included the use of modifiers, more particularly depressants, to depress the non-sulfide gangue minerals so that they do not float along with sulfides thereby reducing the levels of non-sulfide gangue minerals reporting to the concentrates. A depressant is a modifier reagent which acts selectively on certain unwanted minerals and prevents or inhibits their flotation.

In sulfide value mineral flotation, certain non-sulfide silicate gangue minerals present a unique problem in that they exhibit natural floatability, i.e. they float independent of the sulfide value mineral collectors used. Even if very selective sulfide value mineral collectors are used, these silicate minerals report to the sulfide concentrates. Talc and pyrophyllite, both belonging to the class of magnesium silicates, are particularly troublesome in that they are naturally highly hydrophobic. Other magnesium silicate minerals belonging to the classes of olivines, pyroxenes, and serpentine exhibit various degrees of floatability that seems to vary from one ore deposit to the other. The presence of these unwanted minerals in sulfide value mineral concentrates causes many problems i.e. a) they increase the mass of the concentrates thus adding to the cost of handling and transportation of the concentrate, b) they compete for space in the froth phase during the flotation stage thereby reducing the overall sulfide value mineral recovery, and c) they dilute the sulfide concentrate with respect to the value sulfide mineral content which makes them less suitable, and in some cases unsuitable, for the smelting thereof because they interfere with the smelting operation.

The depressants commonly used in sulfide flotation include such materials as inorganic salts (NaCN, NailS, SO2, sodium metabisulfite etc) and small amounts of organic compounds such as sodium thioglycolate, mercaptoethanol etc. These depressants are known to be capable of depressing sulfide minerals but are not known to be depressants for non-sulfide minerals, just as known value sulfide collectors are usually not good collectors for non-sulfide value minerals. Sulfide and non-sulfide minerals have vastly different bulk and surface chemical properties. Their response to various chemicals is also vastly different. At present, certain polysaccharides such as guar gum and carboxy methyl cellulose, are used to depress non-sulfide silicate gangue minerals during sulfide flotation. Their performance, however, is very variable and on some ores they show unacceptable depressant activity and the effective dosage per ton of ore is usually very high (as much as 1 to 10 lbs/ton). Their depressant activity is also influenced by their source and is not consistent from batch to batch. Furthermore, these polysaccharides are also valuable sources of food i.e. their use as depressants reduces their usage as food and, storage thereof presents particular problems with regard to their attractiveness as food for vermin. Lastly, they are not readily miscible or soluble in water and even where water solutions thereof can be made, they are not stable. U.S. Pat. No. 4,902,764 (Rothenberg et al.) describes the use of polyacrylamide-based synthetic copolymers and terpolymers for use as sulfide mineral depressants in the recovery of value sulfide minerals. U.S. Pat. No. 4,720,339 (Nagaraj et al) describes the use of polyacrylamide-based synthetic copolymers and terpolymers as depressants for silicious gangue minerals in the flotation beneficiation of non-sulfide value minerals, but not as depressants in the benefication of sulfide value minerals. The '339 patent teaches that such polymers are effective for silica depression during phosphate flotation which also in the flotation stage uses fatty acids and non-sulfide collectors. The patentees do not teach that such polymers are effective depressants for non-sulfide silicate gangue minerals in the recovery of value sulfide minerals. In fact, such depressants do not exhibit adequate depressant activity for non-sulfide silicate minerals during the beneficiation of sulfide value minerals. U.S. Pat. No. 4,220,525 (Petrovich) teaches that polyhydroxyamines are useful as depressants for gangue minerals including silica, silicates, carbonates, sulfates and phosphates in the recovery of non-sulfide mineral values. Illustrative examples of the polyhydroxyamines disclosed include aminobutanetriols, aminopartitols, aminohexitols, aminoheptitols, aminooctitols, pentose-amines, hexose amines, amino-tetrols etc. U.S. Pat. No. 4,360,425 (Lim etal) describes a method for improving the results of a froth flotation process for the recovery of non-sulfide mineral values wherein a synthetic depressant is added which contains hydroxy and carboxy functionalities. Such depressants are added to the second or amine stage flotation of a double float process for the purpose of depressing non-sulfide value minerals such as phosphate minerals during amine flotation of the siliceous gangue from the second stage concentrate. This patent relates to the use of synthetic depressant during amine flotations only.

In view of the foregoing and especially in view of the teachings of U.S. Pat. No. 4,902,764 which teaches the use of certain polyacrylamide-based copolymers and terpolymers for sulfide mineral depression during the recovery of value sulfide minerals, we have unexpectedly found that certain polymer/polysacchadde blends are indeed excellent depressants for non-sulfide silicate gangue minerals (such as talc, pyroxenes, olivines, serpentine, pyrophyllite, chlorites, biotites, amphiboles, etc). This result is unexpected because such polymer depressants have been disclosed only as sulfide gangue depressants. These synthetic depressant blends have now been found to be excellent alternatives to the polysaccharides used currently alone since the blends are readily miscible or soluble in water, are non-hazardous and their water solutions are stable. The use thereof will increase the availability of polysaccharides as a valuable human food source. The polymer components can be manufactured to adhere to stringent specifications and, accordingly, batch-to-batch consistency is guaranteed. The synthetic polymer components also lend themselves readily to modification of their structure, thereby permitting tailor-making of depressants blends for a given application.

SUMMARY OF THE INVENTION

In accordance with the present invention there is provided a method which comprises beneficiating value sulfide minerals from ores with the selective rejection of non-sulfide silicate gangue minerals by:

a. providing an aqueous pulp slurry of finely-divided, liberation-sized ore particles which contain said value sulfide minerals and said non-sulfide silicate gangue minerals;

b. conditioning said pulp slurry with an effective amount of non-sulfide silicate gangue mineral depressant, a value sulfide mineral collector and a frothing agent, said depressant comprising a mixture of a polysacchadde and a polymer comprising:

(i) x units of the formula:

$$+X+$$

(ii) y units of the formula:

$$+Y+$$

(iii) z units of the formula:

$$+Z+$$

wherein X is the polymerization residue of an acrylamide monomer or mixture of acrylamide monomers, Y is an hydroxy group containing polymer unit, Z is an anionic group containing polymer unit, x represents a residual mole percent fraction of at least about 35%, y is a mole percent fraction ranging from about 1 to about 50% and z is a mole percent fraction ranging from about 0 to about 50% and c. collecting the value sulfide mineral having a reduced content of non sulfide silicate gangue minerals by froth flotation.

DESCRIPTION OF THE INVENTION INCLUDING PREFERRED EMBODIMENTS

The polymer component of the depressant blends of the above formula may comprise, as the (i) units, the polymerization residue of such acrylamides as acrylamide per se, alkyl acrylamides such as methacrylamide, ethacrylamide and the like.

The (ii) units may comprise the polymerization residue of monoethylenically unsaturated hydroxyl group containing copolymerization monomers such as hydroxyalkylacrylates and methacrylates e.g. 1,2-dihydroxypropyl acrylate or methacrylate; hydroxyethyl acrylate or methacrylate; glycidyl methacrylate, acrylamido glycolic acid; hydroxyalkylacrylamides such as N-2-hydroxyethylacrylamide; N-1 hydroxypropylacrylamide; N-bis(1,2-dihydroxyethyl)acrylamide; N-bis(2hydroxypropyl)acrylamide; and the like.

It is preferred that the (ii) units monomers be incorporated into the polymeric component of the depressant blend by copolymerization of an appropriate hydroxyl group containing monomer, however, it is also permissible to impart the hydroxyl group substituent to the already polymerized monomer residue by, for example, hydrolysis thereof or post-reaction of a group thereof susceptible to attachment of the desired hydroxyl group with the appropriate reactant material e.g. glyoxal, such as taught in U.S. Pat. No. 4,902,764, hereby incorporated herein by reference. Glyoxylated polyacrylamide should, however, contain less than about 50 mole percent glyoxylated amide units, i.e. preferably less than about 40 mole percent, more preferably less than 30 mole percent, as the Y units. It is preferred that the Y units of the above formula be a non-α-hydroxyl group of the structure

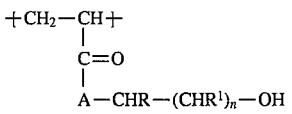

wherein A is 0 or NH, R and $R^1$ are, individually, hydrogen or a $C_1$–$C_4$ alkyl group and n is 1–3, inclusive.

The (iii) units of the polymer components useful in the depressant blends useful herein comprise the polymerization residue of an anionic group containing monoethylenically unsaturated, copolymerizable monomer such as acrylic acid, methacrylic acid, alkali metal or ammonium salts of acrylic and/or methacrylic acid, vinyl sulfonate, vinyl phosphonate, 2-acrylamido-2-methyl propane sulfonic acid, styrene sulfonic acid, maleic acid, fumaric acid, crotonic acid, 2-sulfoethylmethacrylate; 2-acrylamido-2-methyl propane phosphonic acid and the like.

Alternatively, but less desirably, the anionic substituents of the (iii) units of the polymer components used herein may be imparted thereto by post-reaction such as by hydrolysis of a portion of the (i) unit acrylamide polymerization residue of the polymer as also discussed in the above-mentioned '764 patent.

The effective weight average molecular weight range of these polymers is surprisingly very wide, varying from about a few thousand e.g. 5000, to about millions e.g. 10 million, preferably from about ten thousand to about one million.

The polysaccharides useful as a component in the depressant compositions used in the process of the present invention include guar gums; modified guar gums; cellulosics such as carboxymethyl cellulose; starches and the like. Guar gums are preferred.

The ratio of the polysaccharide to the polymer in the depressant composition should range from about 9:1 to about 1:9, respectively, preferably from about 7:3 to about 3:7, respectively, most preferably from about 3:2 to 2:3 respectively.

The dosage of the depressant blends useful in the method of the present invention ranges from bout 0.01 to about 10 pounds of depressant blend per ton of ore, preferably from about 0.1 to about 51 b/ton, most preferably from about 0.1 to about 1.0 lb./ton.

The concentration of (i) units in the polymer component of the depressants used herein should be at least about 35% as a mole percent fraction of the entire polymer, preferably at least about 50%. The concentration of the (ii) units should range from about I to about 50%, as a mole percent fraction, preferably from about 5 to about 20%, while the concentration of the (iii) units should range from about 0 to about 50%, as a mole percent fraction, preferably from about I to about 50% and more preferably from about 1 to about 20%. Mixtures of the polymers composed of the above X, Y and Z units may also be used in ratios of 9:1 to 1:9 in combination with the polysaccharides.

The new method for beneficiating value sulfide minerals employing the synthetic depressant blends of the present invention provides excellent metallurgical recovery with improved grade. A wide range of pH and depressant blend dosage are permissible and compatibility of the depressants with frothers and sulfide value mineral collectors is a plus.

The present invention is directed to the selective removal of non-sulfide silicate gangue minerals that normally report to the value sulfide mineral flotation concentrate, either because of natural floatability or hydrophobicity or otherwise. More particularly, the instant method effects the depression of non-sulfide magnesium silicate minerals while enabling the enhanced recovery of sulfide value minerals. Thus, such materials may be treated as, but not limited to, the following:

| |
|---|
| Talc |
| Pyrophyllite |
| Pyroxene group of Minerals |
| Diopside |
| Augite |
| Homeblendes |
| Enstatite |
| Hypersthene |
| Ferrosilite |
| Bronzite |
| Amphibole group of minerals |
| Tremolite |
| Actinolite |
| Anthophyllite |
| Biotite group of minerals |
| Phlogopite |
| Biotite |
| Chlorite group of minerals |
| Serpentine group of minerals |
| Serpentine |
| Chrysotile |
| Palygorskite |
| Lizardite |
| Anitgorite |
| Olivine group of minerals |
| Olivine |
| Forsterite |
| Hortonolite |
| Fayalite |

The following examples are set forth for purposes of illustration only and are not to be construed as limitations on the present invention except as set forth in the appended claims. All parts and percentages are by weight unless otherwise specified. In the examples, the following designate the monomers used:

AMD=acrylamide
DHPM=1,2-dihydroxypropyl methacrylate
HEM=2-hydroxyethyl methacrylate
AA=acrylic acid
MAMD=methacrylamide
VP=vinylphosphonate
GPAM=glyoxylated poly(acrylamide)
APS=2-acrylamido-2-methylpropane sulfonic acid
VS=vinylsulfonate
CMC=carboxymethyl cellulose
t-BAMD=t-butylacrylamide
HPM=2-hydroxpropyl methacrylate
HEA=1-hydroxethyl acrylate
HPA=1-hyrdoxypropyl acrylate
DHPA=1,2-dihydroxypropyl acrylate
NHE-AMD=N-2-hydroxyethylacrylamide
NHP-AMD=N-2-hydroxypropylacrylamide
NBHE-AMD=N-bis(1,2-dihydroxyethyl)acrylamide
NBEP-AMD=N-bis(1-hydroxypropyl)acrylamide
SEM=2-sulfethylmethacrylate
AMPP=2-acrylamido-2-methylpropane phosphonic acid
C=comparative

EXAMPLES 1–9

An ore containing approximately 3.3% Ni and 16.5% MgO (in the form of Mg silicates) is ground in a laboratory rod mill for 5 minutes to obtain a pulp at a size of 81%–200 mesh. The ground pulp is then transferred to a flotation cell, and is conditioned at the natural pH (~8–8.5) with 150 parts/ton of copper sulfate for 2 minutes, 50 to 100 parts/ton of sodium ethyl xanthate for 2 minutes and then with the desired amount of depressant blend and an alcohol frother for 2 minutes. First stage flotation is then conducted by passing air at approximately 3.5–5 l/min. and a concentrate is collected. In the second stage, the pulp is conditioned with 10 parts/ton of sodium ethyl xanthate, and desired amounts of depressant blend and the frother for 2 minutes and a concentrate is collected. The conditions used in the second stage are also used in the third stage and a concentrate is collected. All of the flotation products are filtered, dried and assayed.

The depressant activity of a 1:1 blend of AMD/DHPM and guar gum is compared with the individual depressants in Table I. With guar alone the Ni recovery is 93% and MgO recovery is 28.3%. With the synthetic polymer depressant alone, the Ni recovery is 84.5% and the MgO recovery is 12.6% which is less than half of that of guar gum, thereby indicating a very strong depressant activity of the synthetic depressant. In the case of the blend, there is a further reduction in MgO recovery and the Ni recovery and grade improve slightly over that of the synthetic depressant. These results demonstrate the greater depressant activity obtained with the blend and also suggest that much lower dosages can be used compared to those of the individual components.

The depressant activity of a 1:1 blend of AMD/HEM polymer and guar gum is compared with that of the individual depressants in Table 2. With guar gum alone, as before, the Ni recovery is 93% and the MgO recovery is 28.3%. With the AMD/HEM copolymer at the same dosage, the MgO recovery is only 7.7% indicating a very strong depressant activity; the Ni recovery is also significantly reduced (68.3% vs. 93% for guar). With the blend, however, the Ni recovery improves significantly (82.8%) while the MgO recovery is maintained at the low level of 8.3%. The results also suggest that a considerably lower dosage can be used with the blend to obtain enhanced performance. In fact, when the dosage is lowered to 430 parts/ton, the Ni recovery increases to 86% (from 82.8%) while the MgO recovery increases to 11.5% (from 8.3%).

TABLE I

| Example | Depressant | g/t | Ni Rec | Ni Grade | Mgo Rec. |
|---|---|---|---|---|---|
| | FEED ASSAY: 3.31% Ni and 17.58% MgO | | | | |
| C | None | 0 | 96.6 | 4.7 | 61.4 |
| 2C | Guar Gum | 350 + 70 + 80 | 93.0 | 7.7 | 28.3 |
| 3C | AMD/DHPM 90/10; 397K | 300 + 60 + 60 | 84.5 | 10.5 | 12.6 |
| 4 | Guar Gum and AMD/DHPM 1:1 90/10; 397K | 350 + 70 + 80 | 85.7 | 11.0 | 10.3 |

TABLE II

| Example | Depressant | g/t | Ni Rec | Ni Grade | MgO Rec. |
|---|---|---|---|---|---|
| | FEED ASSAY: 3.301% Ni and 17.58% MgO | | | | |
| 5C | None | 0 | 96.6 | 4.7 | 61.4 |
| 6C | Guar Gum | 350 + 70 + 80 | 93.0 | 7.7 | 28.3 |
| 7C | AMD/HEM 90/10; 656K | 350 + 70 + 80 | 68.3 | 11.4 | 7.7 |
| 8 | Guar Gum and AMD/HEM 1:1 90/10; 656K | 300 + 70 + 80 | 82.8 | 12.2 | 8.3 |
| 9 | Guar Gum and AMD/HEM 1:1 90/10; 656K | 300 + 60 + 70 | 86.0 | 10.3 | 11.5 |

EXAMPLES 10–25

When the procedures of Examples 1–9 are again followed except that the depressant components are varied, as are their concentrations, as set forth in Table III, below, similar results are achieved.

TABLE III

| Example | Polymer (PM) | Polysaccharide (PS) | PM:PS Ratio |
|---|---|---|---|
| 10 | AMD/MAMD/DHPM 80/10/10; 623K | Guar Gum | 9:1 |
| 11 | AMD/DHPM/AA 80/10/10; 7K | Starch | 1:1 |
| 12 | AMD/DHPM/AA 80/10/10; 750K | CMC | 4:1 |
| 13 | AMD/MAMD/VP 80/10/10; 12K | Modified Guar | 2:3 |
| 14 | GPAM (90/10) | Modified Guar | 1:4 |
| 15 | AMD/HEM/AA 80/10/10; 9K | CMC | 1:1 |
| 16 | AMD/HEM/t-BAMD 89.5/10/0.5 | Guar Gum | 1:9 |
| 17 | AMD/DHPM/APS 80/10/10; 11.7K | Starch | 2:1 |
| 18 | AMD/DHPM/VS 80/10/10; 7.78K | Guar Gum | 3:2 |
| 19 | AMD/HPA 80/20 | Guar Gum | 1:1 |
| 20 | AMD/DHPA/AA 80/10/10 | Guar Gum | 1:1 |
| 21 | AMD/NHE-AMD 90/10 | CMC | 1:1 |
| 22 | AMD/NBHE-AMD/BAMD 89.5/10/0.5 | Starch | 1:1 |
| 23 | AMD/NHP-AMD/MAMD 80/10/10 | Guar Gum | 1:1 |
| 24 | AMD/NBEP-AMD 95/5 | Guar Gum | 1:1 |
| 25 | AMD/HEM/SEM 80/10/10 | Guar Gum | 1:1 |

We claim:

1. A method which comprises beneficiating value sulfide minerals from ores with selective rejection of non-sulfide silicate gangue minerals by:

a. providing an aqueous pulp slurry of finely-divided, liberation-sized ore particles which contain said value sulfide minerals and said non-sulfide silicate gangue minerals;

b. conditioning said pulp slurry with an effective amount of non-sulfide silicate gangue mineral depressant, a value sulfide mineral collector and a frothing agent, respectively, said depressant comprising a mixture of a polysaccharide and a polymer comprising:

(i) x units of the formula:

$$+X+$$

(ii) y units of the formula:

$$+Y+$$

(iii) z units of the formula:

+z+ wherein X is the polymerization residue of an acrylamide monomer or mixture of such acrylamide monomers, Y is a hydroxy group containing polymer unit derived from a monoethylenically unsaturated monomer, Z is an anionic group containing polymer unit derived from a monoethylenically unsaturated monomer, x represents a residual mole percent fraction of over about 35%, y is a mole percent fraction ranging from about 1 to about 50% and z is a mole percent fraction ranging from about 0 to about 50%;

c. subjecting the conditioned pulp slurry to froth flotation and collecting the value sulfide mineral having a reduced content of non-sulfide silicate gangue minerals.

2. A method according to claim 1 wherein Y has the formula

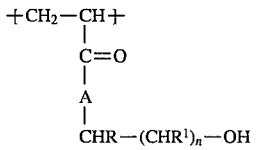

wherein A is O or NH, R and $R^1$ are, individually, hydrogen or a $C_1$–$C_4$ alkyl group and n is 1–3, inclusive.

3. A method according to claim 1 wherein X is the polymerization residue of acrylamide, Y is the polymerization residue of 1,2-dihydroxypropyl methacrylate and z is 0.

4. A method according to claim 1 wherein X is the polymerization residue of acrylamide, Y is the polymerization residue of 1, 2-dihydroxypropyl methacrylate, Z is the polymerization residue of acrylic acid and z is a mole percent fraction ranging from about 1 to about 50.

5. A method according to claim 1 wherein X is the polymerization residue of acrylamide, Y is the polymerization residue of hydroxyethyl methacrylate and z is 0.

6. A method according to claim 1 wherein X is the polymerization residue of acrylamide, Y is the polymerization residue of hydroxyethyl methacrylate, Z is the polymerization residue of acrylic acid and z is a mole percent fraction ranging from about 1 to about 50%.

7. A method according to claim 1 wherein X is the polymerization residue of acrylamide, Y is the polymerization residue of 1,2-dihydroxypropyl methacrylate, Z is the polymerization residue of vinyl sulfonate and z is a mole percent fraction ranging from about 1 to about 50%.

8. A method according to claim 1 wherein X is the polymerization residue of acrylamide, Y is the polymerization residue of 1,2-dihydroxypropyl methacrylate, Z is the polymerization residue of vinyl phosphonate and z is a mole percent fraction ranging from about 1 to about 50%.

9. A method according to claim 1 wherein X is the polymerization residue of acrylamide, Y is the polymerization residue of hydroxyethyl methacrylate, Z is the polymerization residue of vinyl sulfonate and z is a mole percent fraction ranging from about 1 to about 50%.

10. A method according to claim 1 wherein X is the polymerization residue of acrylamide, Y is the polymerization residue of hydroxyethyl methacrylate, Z is the polymerization residue of vinyl phosphonate and z is a mole percent fraction ranging from about 1 to about 50%.

11. A method according to claim 1 wherein X is the polymerization residue of acrylamide, Y is the polymerization residue of 1, 2-dihydroxypropyl methacrylate, Z is the polymerization residue of 2-acrylamido-2-methyl propane sulfonic acid and z is a mole percent fraction ranging from about 1 to about 50.

12. A method according to claim 1 wherein X is the polymerization residue of acrylamide, Y is the polymerization residue of hydroxyethyl methacrylate, Z is the polymerization residue of 2-acrylamido-2-methyl propane sulfonic acid and z is a mole percent fraction ranging from about 1 to about 50%.

13. A method according to claim 1 wherein X is the polymerization residue of acrylamide and t-butylacrylamide, Y is the polymerization residue of 1,2dihydroxypropyl methacrylate and z is 0.

14. A method according to claim 1 wherein X is the polymerization residue of acrylamide, and methacrylamide, Y is the polymerization residue of 1,2-dihydroxypropyl methacrylate and z is 0.

15. A method according to claim 1 wherein X is the polymerization residue of acrylamide and methacrylamide, Y is the polymerization residue of hydroxyethyl methacrylate and z is 0.

16. A method according to claim 1 wherein Y represents a glyoxylated acrylamide unit and y is less than about 40.

17. A method according to claim 1 wherein X is the polymerization residue of acrylamide and t-butylacrylamide, Y is the polymerization residue of hydroxyethyl methacrylate and z is 0.

18. A method according to claim 1 wherein the polysaccharide is guar gum.

19. A method according to claim 1 wherein the polysaccharide is carboxymethyl cellulose.

20. A method according to claim 1 wherein the polysaccharide is starch.

* * * * *